US005640793A

United States Patent [19]

Fischer

[11] Patent Number: 5,640,793

[45] Date of Patent: Jun. 24, 1997

[54] DEVICE FOR EXHIBITING FLAT ARTICLES

[75] Inventor: Klaus Fischer, Frankfurt am Main, Germany

[73] Assignee: Glasbau Hahn GmbH & Co. KG, Germany

[21] Appl. No.: 415,711

[22] Filed: Apr. 3, 1995

[30] Foreign Application Priority Data

Apr. 1, 1994 [EP] European Pat. Off. ..... 94105207

[51] Int. Cl.[6] ..... A47G 1/06

[52] U.S. Cl. ..... 40/718; 40/732

[58] Field of Search ..... 40/718, 790, 732

[56] References Cited

U.S. PATENT DOCUMENTS 1,041,776 10/1912 Gibson ..... 40/732
1,048,343 12/1912 Rice ..... 40/718 X

FOREIGN PATENT DOCUMENTS 112311 3/1956 France ..... 40/732

*Primary Examiner*—Kenneth J. Dorner
*Assistant Examiner*—Cassandra Davis
*Attorney, Agent, or Firm*—Haynes and Boone, L.L.P.

[57] ABSTRACT

A device for exhibiting flat articles consists of a profiled frame, which surrounds a picture on all sides round its outside. A flange is formed on an inwardly directed web of the profiled frame which is in register with a further web running parallel to the rear side of the picture frame, the flange facing towards the viewer and having a sheet of glass fixed to its end, the glass closing the profiled frame on the side facing the viewer. The picture is pressed against the side of the web facing away from the viewer by elastic pads, which bear against a rear wall connected to the rear side of the profiled frame. The edge and the marginal region of the sheet of glass are received by a rectangular recess of the picture frame. Since the inwardly directed web is in register with the outwardly directed further web, the face side of the picture is located in a plane behind the rear side of the picture frame. The device according to the invention can protect a picture from damage and also against environmental effects given an air-tight implementation of the frame receiving the picture, while the overall impression of the picture and the picture frame stays virtually unchanged and reworking of the picture frame to receive the profiled frame is dispensed with.

19 Claims, 7 Drawing Sheets

DEVICE FOR EXHIBITING FLAT ARTICLES

Figure 1:
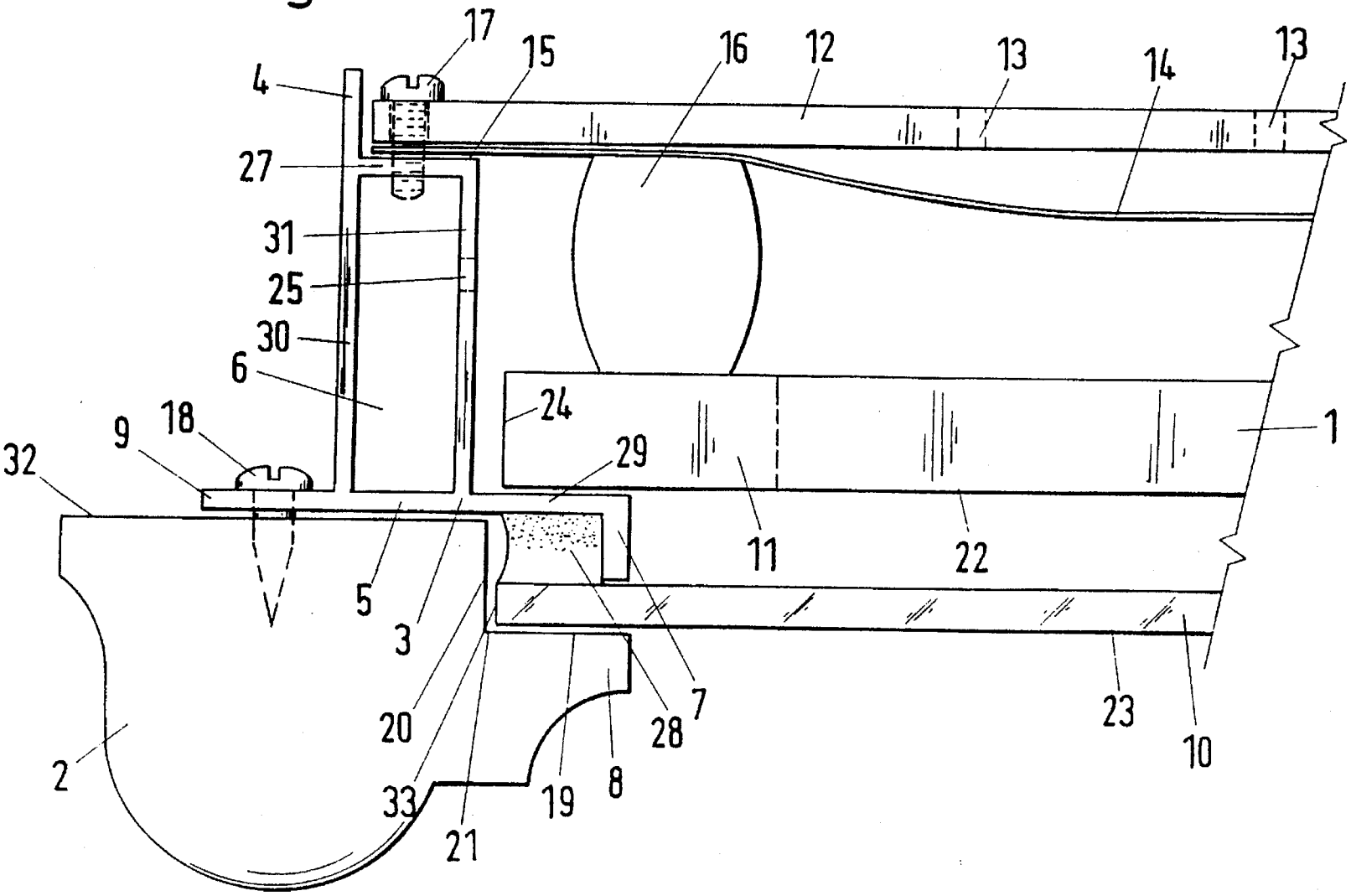

This invention relates to a device for exhibiting flat articles, for example, a picture in a picture frame, wherein the picture frame has on its inside, facing the face side of the picture, a surrounding rectangular recess receiving the picture within its outer periphery, with surfaces facing the face side of the picture and facing the outside of the picture, the picture being positioned in a housing surrounding it on all sides.

Pictures, such as oil paintings on canvas or a wood board or metal are usually held in the same surrounding picture frame as is used to attach hanging devices. The picture is thus in a surrounding rectangular recess located on the inside of the picture frame, so that the marginal regions of the picture are covered by the picture frame.

Valuable oil paintings are not only liable to damage or theft in public exhibitions but also require a particular atmosphere so far as the ambient air is concerned, for example substantial freedom from dust, a certain humidity, freedom from contaminants, etc.

It is already known, especially in order to prevent damage, to cover the picture with a sheet of glass, which is also retained by the picture frame. Further measures often result in the accessibility of the picture to be viewed or the picture frame being affected by additional devices, so that the overall impression is spoilt.

It has already been proposed to place the picture in a housing, which consists of like housing under and top parts of PLEXIGLASS, the top part of the housing being covered by a non-reflective glass plate. The picture is held in the housing by felt strips and foamed plastics material and the housing is likewise positioned in the picture frame by felt strips and retained by catches screwed to the rear side of the picture frame. Such a housing is described in a brochure of the company Rotherein, Postfach 10 02 51, 5270 Gummersbach for example.

It does appear from the cited document that such a protected picture with its housing will be capable of fitting in the existing frame again, but this is only so if there is sufficient distance between the outside of the picture and the recess receiving the picture. Otherwise it is necessary to rework the picture frame to receive the housing, since at least the wall thickness of the housing receiving the picture and possibly also the thickness of the picture and the intervening felt strips positioning the housing have to be taken into account in determining the space at the side between the outside of the picture and the recess in the picture frame.

The object of the present invention is to provide a device through which the protection of the picture against damage and environmental effects is obtained, without the overall impression of the picture and picture frame being specially affected and in any case so as to avoid reworking the picture frame to receive the housing.

This object is met in that a profiled frame surrounds the picture on all sides and is closed on the side facing the viewer by a sheet of glass and on the rear side by a rear wall, in that the outside facing the viewer and the side of the glass sheet are received by the rectangular recess, the profiled frame being fixed on to the picture frame and being so formed that the face side of the picture is located in plane behind the rear side of the picture frame.

The profiled frame surrounding the picture on all sides around its periphery receives the picture, which is visible through the sheet of glass, and is closed at the rear by a rear wall. Because of the special construction of the profiled frame, which is received by the recess in the picture frame, the picture is outside the picture frame, so that this does not have to be altered to receive the profiled frame, i.e. it does not have to be reworked. This ensures that the overall impression of the picture and the picture frame is retained, in spite of the measures taken to protect the picture. It is accordingly also possible at any time to take the picture and frame apart to their original state, for example in the case of return from a public exhibition after a temporary loan of a picture in private possession.

The construction of a show-case, which consists of a profiled frame and is closed on its front side by a sheet of glass and on its rear side by a rear wall is already known from DE-OS 2 711 353. A magnetic plate is provided in the inside of the rear wall for attaching notices, etc.

German utility model G 82 17 421 U1 concerns a facade frame for display and information cases, which comprises a base frame and an ornamental frame attached thereto.

Furthermore an information cabinet is known from German utility model G 76 00 360, with a square or rectangular support frame which receives the information carrier, whose top part, bottom part and two side parts are all formed from like profiled parts.

The man skilled in the art does not obtain from any of the references any suggestion leading to the solution according to the invention.

Figure 2:
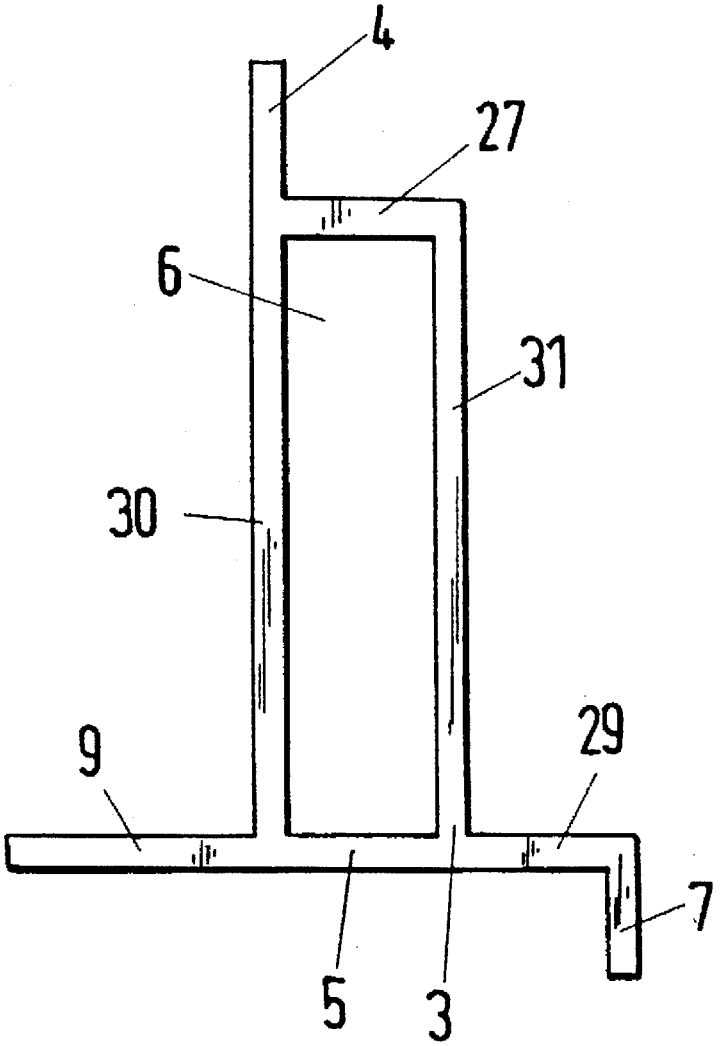
Figure 3:
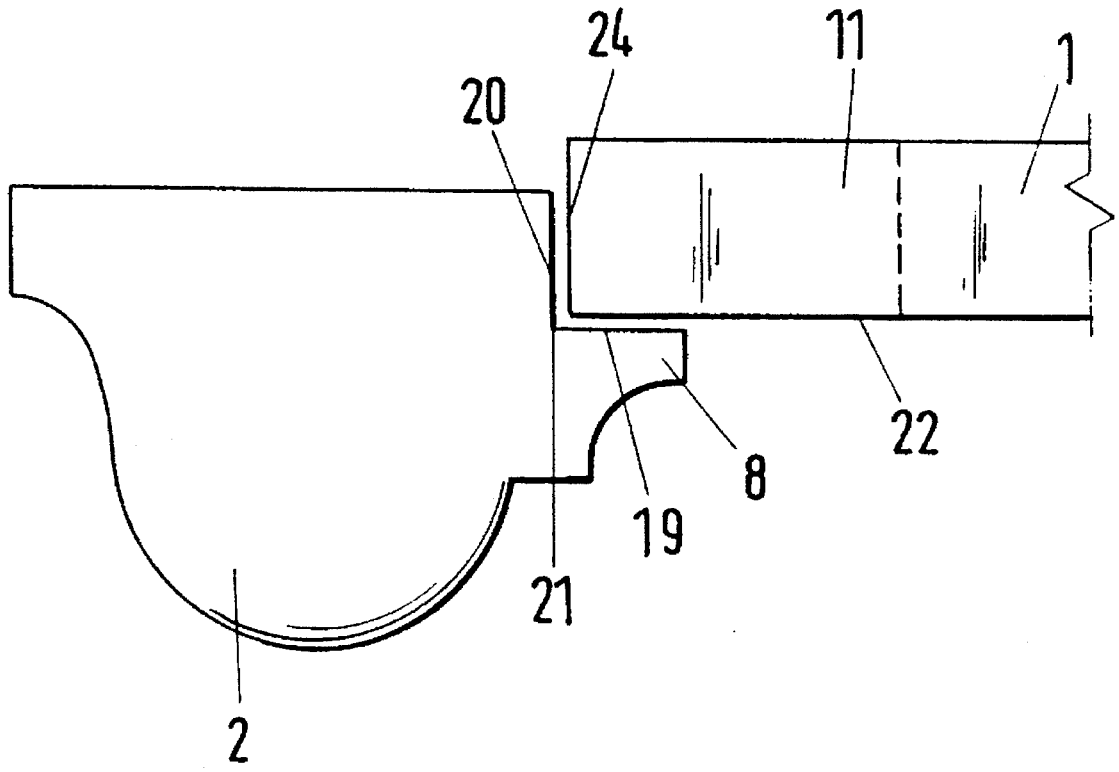
Figure 4:
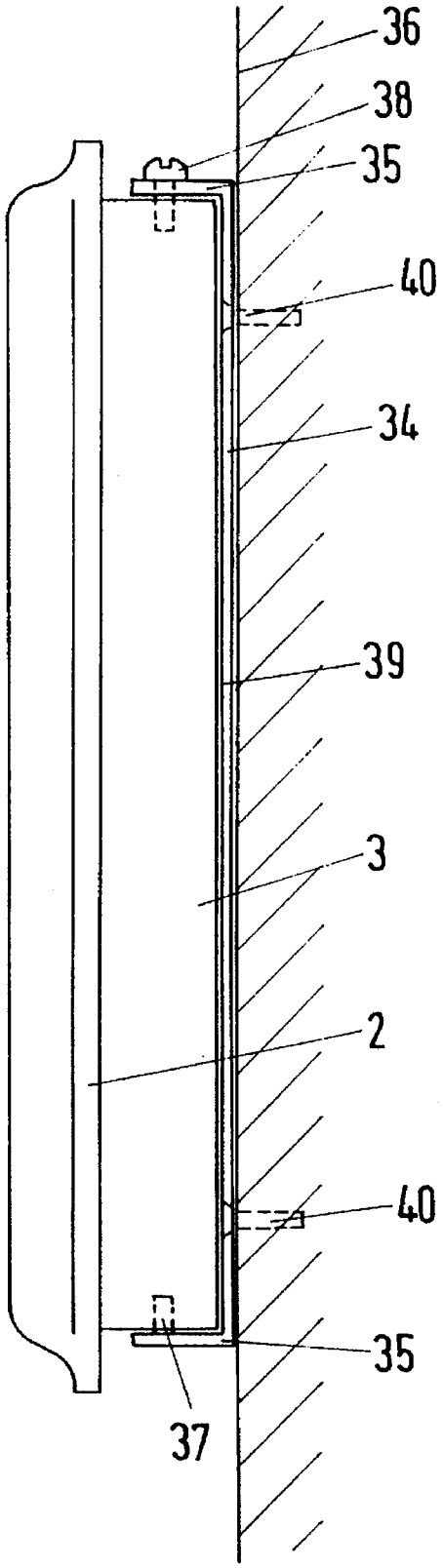
Figure 5:
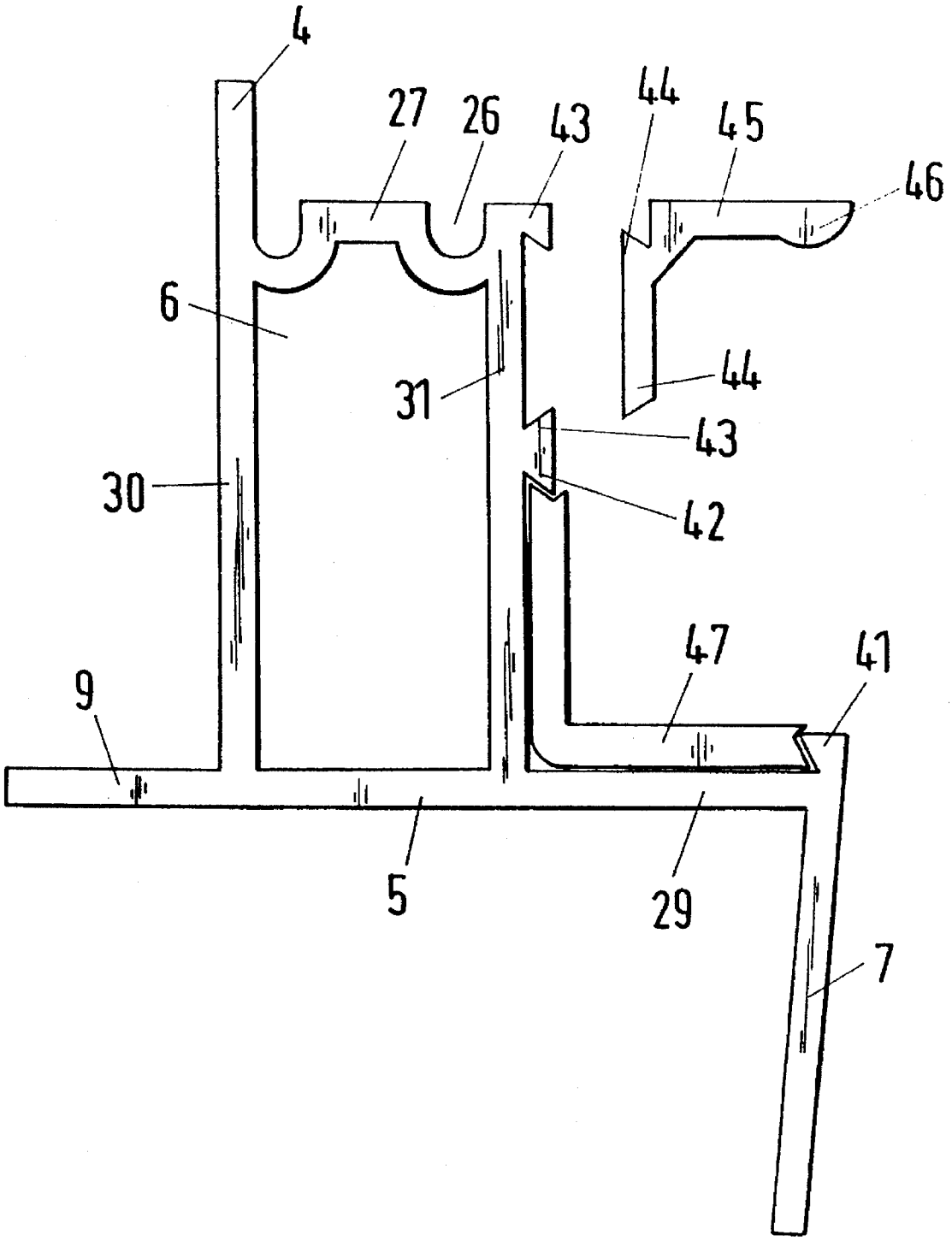
Figure 6:
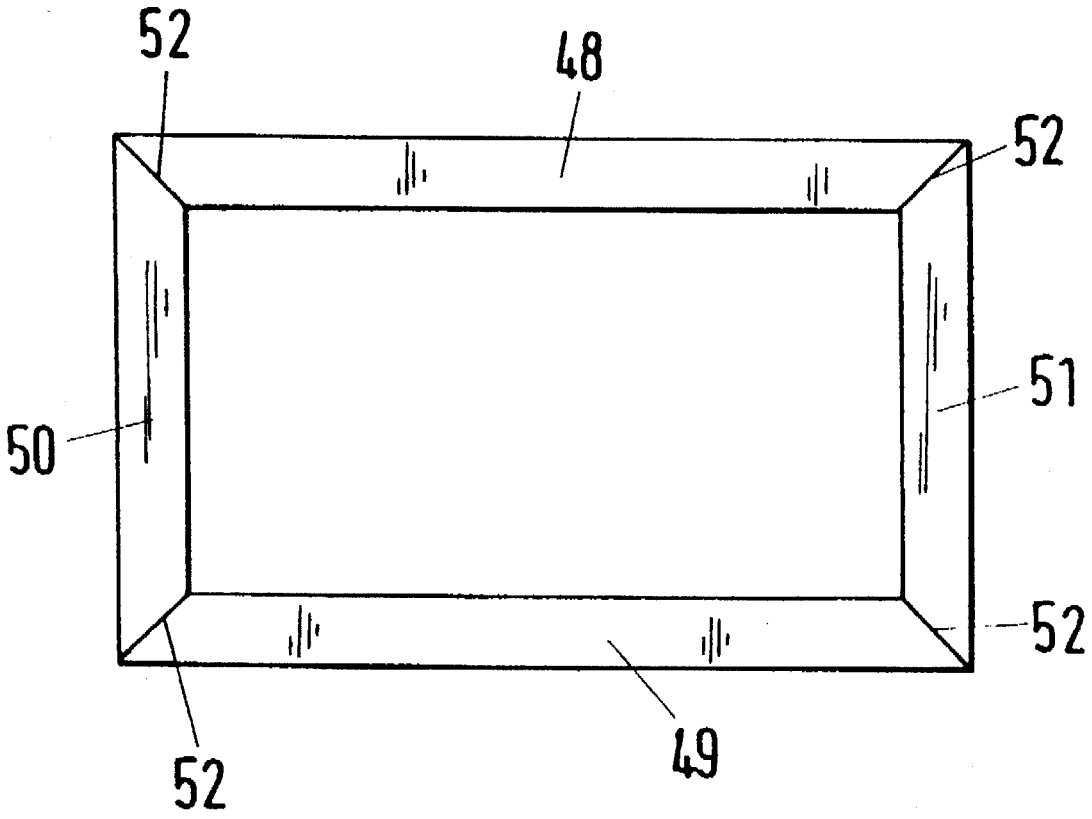
Figure 7:
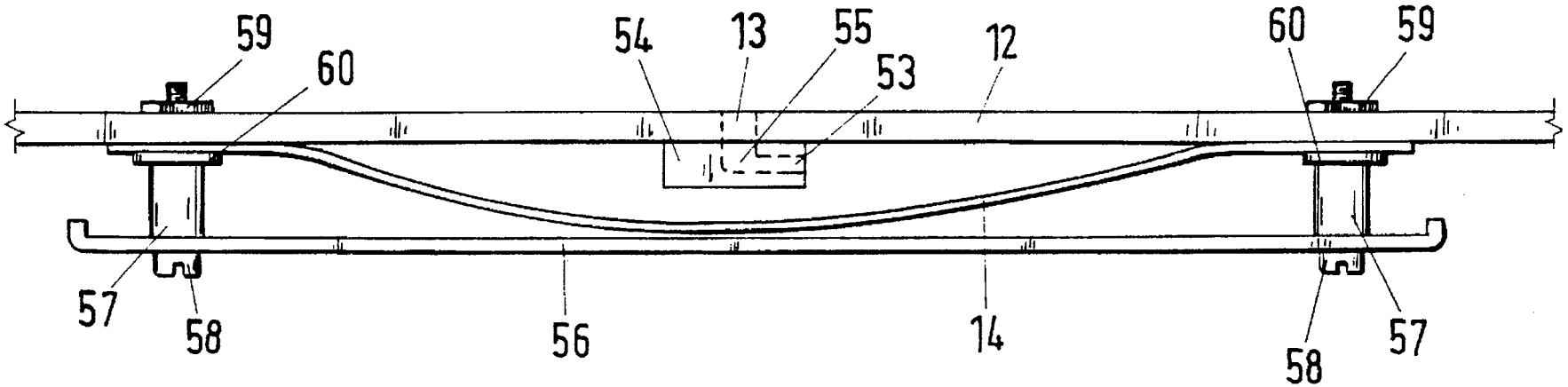

Advantageous developments of the invention will be explained in more detail with reference to embodiments, which are shown in the drawings, wherein:

FIG. 1 is a cross-section through a picture frame, a profiled frame and a picture, FIG. 2 is a cross-section through the profiled frame, FIG. 3 is a cross-section through a picture frame and a picture, FIG. 4 is a cross-section through a profiled frame fixed to the wall, FIG. 5 is a cross-section through a further profiled frame, FIG. 6 is a front view of the complete profiled frame and FIG. 7 is a cross-section through the rear wall.

In FIG. 3 there is shown a cross-section through a picture frame 2, which surrounds a picture 1. The picture frame 2 has a lip 8 which covers the picture 1 round its marginal region. The picture 1 is received by a rectangular recess 21, which is formed by a surface 19 facing the face side 22, of the picture 1 and a surface 20 facing the outer edge 24 of the picture 1. The picture 1 consists of a wooden frame 11, over which a canvas is stretched on the face side 22, facing the viewer. The invention is not however limited to the use of picture frames 2 which serve to receive pictures on canvas but rather the picture 1 can be applied to a wood board or metal plate.

The profiled frame 3 according to the invention consists of like profiled parts (FIGS. 2 and 5), which form the top part 48, the bottom part 49 and the two side parts 50 and 51. The ends are preferably all given miters 52 and fixed together by adhesive, screwing, riveting, etc. If an airtight interior space is desired, the joints between the two parts are each suitably sealed.

The profiled frame 3 consists of an outer wall 30, an inner wall 31 running parallel thereto, a front wall 5 perpendicular to both the former and a rear end 27 running parallel to the front wall. Furthermore webs 9 and 29 in register with the front wall 5 are fitted on the outer wall 30 and the inner wall 31 respectively. On the end of the web 29 there is a flange 7 facing towards the viewer and at right angles to the web 29. Moreover, the region of the rear end 27 there is a stop 4 in alignment with the outer wall 30. A closed hollow space 6 is formed by the outer wall 30, the inner wall 31, the front wall 5 and the rear end 27. The stop 4, the webs 9 and 29, the flange 7 and the parts 5, 27, 30 and 31 forming the hollow space 6 are all connected together unitarily and are preferably in the form of a light metal or plastics extrusion molding.

According to FIG. 1, a sheet of glass 10 is fixed to the profiled frame 3, the rear side of the sheet of glass 10 facing the picture 1 bearing on the end of the flange 7 in such a way that a space is formed by the overlapping glass sheet 10, the flange 7 and the web 29 for reception of fixing means 28, for example in the form of an adhesive, by means of which the sheet of glass 10 is firmly attached to the profiled frame 3. The edge 33 of the sheet of glass 10 then bears against the surface 20 of the recess 21 in the picture frame 2 which normally faces the outside 24 of the picture 1. This means that the distance between the outside 24 of the picture 1 and the outside of the inner wall 31 of the profiled frame 3 is determined by the amount of overlap of the sheet of glass 10 beyond the flange 7, since the face side 22 of the picture 1 facing the viewer bears against the side of the web 29 facing away from the viewer and the web 9 in register therewith bears parallel against the rear side 32 of the picture frame 2. Thus the external dimensions of the sheet of glass 10 are determined only by the dimensions of the recess 21 in the picture frame 2 while the mount of the overlap of the sheet of glass 10 beyond the flange 7 is determined by the length of the respective profiled parts of the top part 48, the bottom part 49 and the two side parts 50 and 51 (FIG. 6). The length of the flange 7, which can moreover be provided on the outer side visible to the viewer with a dark color of a color matched to the picture frame 2, is determined by the depth of the surface 20 of the recess 21 in the picture frame 2. Depending on the thickness of the picture 1, it can be necessary to shorten the length of the flange 7 suitably or to have available a plurality of profiled flames 3 with flanges 7 of different lengths. The external dimensions of the sheet of glass 10 are so selected that this is received by the rectangular recess 21 in the picture frame 2, allowing for a certain gap. Likewise, the lengths of the top part 48, the bottom part 49 and the two side parts 50 and 51 are so selected that there is a certain gap between the outside 24 of the picture 1 and the outside of the inner wall 31. This gap can for example be used for an intermediate layer in the form of a felt strip.

In order to fix the profiled frame 3 to the rear side of the picture frame 2 by means of wood screws 18, the web 9 of the profiled frame 3 is provided with suitable bores.

The sheet of glass 10 can be made from a multi-layer bonded glass, the outer side 23 facing the viewer being suitably treated in any event to avoid reflections.

The rear end 27 has bores for fixing a rear wall 12 on to the profiled frame 3 by means of metal screws 17, the rear wall closing the profiled frame 3 at the rear, the edges of the rear wall 12 each bearing against the stop 4. In between the rear wall 12 and the picture 1 can be fitted an elastic pad 16, in the form of foamed material strips for example, which press the outside 22 of the picture facing the viewer against the rear side of the web 29 of the profiled frame 3.

In between the rear end 27 and the rear wall 12 can be fitted a continuous sealing strip 15, so that it is possible to seal the space for reception of the picture 1 formed by the profiled frame 3, the sheet of glass 10 and the rear wall 12 in airtight manner. In order to compensate for fluctuations in air pressure, an airtight film 14 can be fitted between the rear end 27 of the profiled frame 3 or the sealing strip 15 and the rear wall 12, this film separating the space receiving the picture 1 from the external world, while the space between the rear wall 12 and the film 14 is in communication with the outside world through openings 13 in the rear wall. In this manner, the ability of the film 14 to move equalizes the air pressure in the space containing the picture 1. The elastic pads 16, which press against the wood frame 11 of the picture 1, only affect the ability of the film 14 to move in its edge region, since they advantageously act against the wood frame 11 of the picture 1.

The hollow space 6 of the profiled frame 3 does not only have the purpose of stabilizing the profiled frame against twisting; it can also serve to receive hygroscopic material for maintaining a predetermined air humidity within the space receiving the picture 1, for which purposes the inner wall 81 of the profiled frame 3 is provided with openings 25, so that the hollow space 6 is in communication with space receiving the picture 1. The openings 25 are so placed that they are not covered by the outside 24 of the picture 1. The hollow space 6 in a side part of the profiled frame 3 can also serve to receive a miniature hygrometer, which is visible through an airtight window fitted in the outer wall 30 of the profiled frame 3.

In order to attach the profiled frame 3 securely to a wall 36, a suitably shaped sheet metal frame 34 (see FIG. 4) can be used, which is attached to the wall by a wall fixing 40 and has flanged sheet metal strips in the form of a flange 35 in each of its top and bottom regions, surrounding the profiled frame 3 continuously or at least in part at its top side 48 and bottom side 49. One or more upwardly directed pins 37 are fitted on the bottom flange 35 and engages in corresponding bores in the profiled frame 3 in the region of the hollow space 6. The profiled frame 3 is retained by screws 38 which are screwed through the upper flange 35 into the profiled frame 3, likewise in the region of the hollow space 6. If an airtight space in communication with the hollow space 6 is required for reception of the picture 1, care must obviously be taken that those parts of the hollow space 6 are separated in airtight manner from the other regions of the hollow space 6 into which the pins 37 or screws 38 project to fix the profiled frame 3 on to the wall 36. Two suitably spaced angle irons could be fixed to the wall 36 in place of the sheet metal frame 34.

In order to protect the picture 1 surrounded by the device according to the invention, one or more alarm sensors 39 of an alarm system can be fitted between the rear wall 12 and the sheet meal frame 34 or the wall 36, which generate an alarm signal as soon as the profiled frame 3 is released in unauthorized manner from the sheet metal frame 34 or from the wall 36.

The picture 1 can also be hung either as before in its picture frame 2 or on eyes, which are fitted to the profiled frame 3, namely on the top part 48 on the outer wall 30.

According to FIG. 5, the profiled frame 3 can be fitted with a first nose 41 on the front wall 5, in register with the flange 7 and with a second nose 42 on the inner wall 31, which noses retain a strip of felt 47 bent at right angles, against which the marginal region of the picture bears at its face side 22 and its outside 24 respectively. In order that the elastic pad 16 shall not press the film 14 out when the rear wall is released, the inner wall 31 of the profiled frame 3 can be provided with two oppositely directed noses 48, in which a dovetail guide 44 of an insert 45 can slide. The insert 45 has a stop 46 which, in the fitted state of the insert 45 is aligned with the rear end 27 and against which the elastic pad 15 abuts. The insert 45 can likewise be made of a plastics or aluminum extrusion molding and it is sufficient for a short insert 45 to be fitted in the profiled frame 3 for a paid 16. The rear end 27 can also be provided with one or more grooves 26 for reception of respective sealing section strips instead of the flat sealing strip 15. The noses 41, 42 and 43 can be made continuous and in one piece with the profiled frame 3. For optical or other reasons the flange 7 can be slightly inclined to the outside of the profiled frame 3.

The web 9 can be provided with parts for temporary fitting of a handle or a suspension device for purposes of transport, in order to be able to transport the case easily and safely.

The film 14 can also be attached outside the marginal region of the rear wall 12 to the same by adhesive for example (FIG. 7). In order to protect against penetration of the film 14 through the openings 13 in the rear wall 12, a plastics part 54 is fitted on the inside of the rear wall 12, its opening 55 being in the form of a blind bore in register with the opening 13 in the rear wall. The communication between the space the film 14 and the rear wall 12 and the outside is made by a side opening 58 transverse to the opening 55. The film 14 is protected when the rear wall 12 is taken off by a protective sheet 56 placed over the film 14 and fitted parallel to the rear wall 12 by spacers 57 of suitable length and retained by screws 58. A washer 60 can be provided between the spacer 57 and the film 14. The screws 57 can each be retained by a nut 59 on the rear wall.

Depending on the size of a device according to the invention receiving a picture, a plurality of films 14, each with a protective sheet 56, can be fitted on the rear wall 12.

What is claimed is:

1. A device for exhibiting a flat article in a display frame, said display frame having a front side and a rear side and further having an inner periphery defining a recess, said recess having a rectangular cross-section defined by first and second substantially orthogonal surfaces arranged for receiving an outer periphery of said article, comprising:

a profiled frame for receiving said flat article and encompassing said outer periphery of said article, said profiled frame having front and rear sides and a first web configured to bear against the rear side of said display frame;

a sheet of glass secured to said front side of said profiled frame, said sheet of glass extending across said front side of said profiled frame sufficiently to seal said front side of said profiled frame, said profiled frame being configured to be secured to said display frame so that said glass is received by said recess and so that said flat article may be received by said profiled frame in a plane behind the rear side of said display frame;

a rear wall secured to said rear side of said profiled frame, said wall extending across said rear side of said profiled frame sufficiently to seal said rear side of said profiled frame; and means for releasably securing said web to said display frame.

2. The device of claim 1 wherein said first web is provided with elements which facilitate temporary fitting of a carrying handle for transport purposes.

3. The device of claim 1 wherein said first web is provided with elements which facilitate temporary fitting of a suspension device for transport purposes.

4. The device of claim 1, further comprising:

a second web registering with said first web;

a flange configured for extending from an end of said second web toward the front side of said display frame; and means for securing said sheet of glass to said profiled frame, said securing means disposed in a space defined between said second web, said flange, and said sheet of glass projecting thereover so that said glass bears on an end of said flange.

5. The device of claim 4, further comprising elastic pads disposed between said rear wall and said flat article so that said pads urge said flat article against said second web.

6. The device of claim 4, wherein said profiled frame includes opposing inner and outer walls and opposing front wall and rear end which define a hollow space located therebetween.

7. The device of claim 6 wherein said profiled frame defines openings between said hollow space and a space defined between said rear wall and said sheet of glass received by said profiled frame, said hollow space being filled with hygroscopic material.

8. The device of claim 6 wherein said profiled frame is provided with an air-tight window adjacent said hollow space.

9. The device of claim 6 further comprising a support structure having lower and upper flanged portions, at least one pin connectable to said lower flange, and at least one screw connectable to said upper flange, and wherein a plurality of said display frames and a plurality of said profiled frames corresponding to said plurality of said display frames are configured for being coupled together to form a contiguous frame, and wherein said hollow space of at least one of a first of said profiled frames has air-tight communication with an inner space defined between said rear wall and said sheet of glass, said outer wall of at least one of a second of said profiled frames define at least one bore for receiving said at least one pin, said outer wall of at least one of a third of said profiled frames define at least one bore for receiving said at least one screw.

10. The device of claim 6, wherein said second web includes a first nose formed thereon, said inner wall of said profiled frame includes a second nose formed thereon, said device further comprises a strip of felt bent at right angles and retained between said first and second noses for seating said outer periphery of said article.

11. The device of claim 6 further comprising an insert having a dovetail guide and a stop extending therefrom, wherein said outside of said inner wall of said profiled frame includes two oppositely directed noses for receiving said dovetail guide, said stop registering with the rear end of said profiled frame; and elastic pads disposed between said stop and said flat article so that said pads urge said flat article against said second web.

12. The device of claim 6 wherein said flange is slightly inclined relative to said front wall.

13. The device of claim 6, wherein said profiled frame further comprises a stop fitted on said rear side thereof.

14. The device of claim 13 wherein said stop, said front wall, said flange, and said first and second webs are formed unitarily as an extruded portion of said profiled frame, where like extruded portions form a bottom portion, a top portion, and two side portions, which portions are connected together to form said profiled frame.

15. The device of claim 13, further comprising means for securing said rear wall to said profiled frame such that an edge of said rear wall bears on said stop.

16. A device for exhibiting a flat article in a display frame, said display frame having a front side and a rear side and further having an inner periphery defining a recess, said recess having a rectangular cross-section defined by first and second substantially orthogonal surfaces arranged for receiving an outer periphery of said article, comprising:

a profiled frame for receiving said flat article and encompassing said outer periphery of said article, said profiled frame having front and rear sides;

a sheet of glass secured to said front side of said profiled frame, said sheet of glass extending across said front side of said profiled frame sufficiently to seal said front side of said profiled frame, said profiled frame being configured to be secured to said display frame so that said glass is received by said recess and so that said flat article may be received by said profiled frame in a plane behind the rear side of said display frame;

a rear wall secured to said rear side of said profiled frame, said wall extending across said rear side of said profiled frame sufficiently to seal said rear side of said profiled frame; and an air-tight film disposed between said rear wall and said profiled frame, and wherein said rear wall defines at least one opening.

17. The device of claim 16 wherein said rear wall defines a first opening, and said device further comprises adhesive securing said film to said rear wall in the region of said first opening in said rear wall.

18. The device of claim 17 further comprising a plastic part having a second opening, said plastic part being disposed on said rear wall between said rear wall and said article so that said first opening registers with said second opening, and so that said plastic part has a third opening transverse to and in fluid communication with said second opening.

19. The device of claim 17 further comprising a protective sheet disposed substantially parallel to said rear wall in the region of the film.

* * * * *

UNITED STATES PATENT AND TRADEMARK OFFICE

CERTIFICATE OF CORRECTION

PATENT NO. : 5,640,793

DATED : June 24, 1997

INVENTOR(S) : Klaus Fischer

It is certified that error appears in the above-identified patent and that said Letters Patent is hereby corrected as shown below:

Column 1, line 36, "Rotherein" should be --Rothstein--.

Column 3, line 26, "mount" should be --amount--.

Column 3, line 36, "flames" should be -- frames--.

Column 4, line 14, "wall 81" should be --wall 31--.

Column 4, line 60, "noses 48" should be --noses 43--.

Signed and Sealed this

Third Day of March, 1998

*Attest:*

Bruce Lehman

BRUCE LEHMAN

*Attesting Officer*

*Commissioner of Patents and Trademarks*